United States Patent [19]

Cope et al.

[11] Patent Number: 4,946,395

[45] Date of Patent: Aug. 7, 1990

[54] ELECTRICAL CONNECTOR WITH CONNECTOR POSITION ASSURANCE DEVICE

[75] Inventors: Kenneth P. Cope, Warren; Raymond A. Maga, Poland; Teddy L. Hall, Columbiana, all of Ohio

[73] Assignee: General Motors Corporation, Detroit, Mich.

[21] Appl. No.: 380,571

[22] Filed: Jul. 17, 1989

[51] Int. Cl.[5] ..... H01R 13/627

[52] U.S. Cl. ..... 439/352; 439/357; 439/489

[58] Field of Search ..... 439/350, 351, 352, 353, 439/354, 355, 356, 357, 358, 488, 489, 490, 491

[56] References Cited

U.S. PATENT DOCUMENTS

| | | | |
|---|---|---|---|
| 4,370,013 | 1/1983 | Niitsu et al. | 339/82 |
| 4,634,204 | 1/1987 | Detter et al. | 339/91 R |
| 4,708,413 | 11/1987 | Schroeder | 439/358 |
| 4,746,306 | 5/1988 | Yurtin et al. | 439/357 |
| 4,810,210 | 3/1989 | Komatsu | 439/352 X |

*Primary Examiner*—Neil Abrams
*Assistant Examiner*—Khiem Nguyen
*Attorney, Agent, or Firm*—F. J. Fodale

[57] ABSTRACT

An electrical connector comprises a socket connector body which has a flexible lock arm and connector position device slideably retained on it. The connector position assurance device moves from a rearward release position when the flexible lock arm flexes outwardly to engage a lock shoulder of a mating connector body to a forward lock position where the flexible lock arm is blocked against outward movement.

6 Claims, 2 Drawing Sheets

ELECTRICAL CONNECTOR WITH CONNECTOR POSITION ASSURANCE DEVICE

BACKGROUND OF THE INVENTION

This invention relates generally to electrical connectors and more specifically to electrical connectors which have a connector position assurance device to assure that mating connectors are properly mated and locked together.

Electrical connectors which have such devices are already known in the prior art.

U.S. Pat. No. 4,370,013 issued to Mitsugi Niitsu et al Jan. 25, 1983 shows a connector device for electric circuit comprising male and female connector housings which are locked together by a flexible tongue piece of one connector housing engaging a cross piece of the other connector housing. When the connector housings are fastened, an insertion piece is inserted below the cross piece between the flexible tongue piece and the connector housing having the cross piece to prevent disengagement of the flexible tongue piece from the cross piece.

U.S. Pat. No. 4,746,306 issued to John A. Yurtin et al May 24, 1988 shows an electrical connector comprising dielectric connector bodies which are coupled and locked together by a resilient lock member of one connector body which engages a lock member of the other connector body to form a gauge hole. The gauge hole receives a gauge pin if the connector bodies are properly mated and locked together.

U.S. Pat. No. 4,634,204 issued to Gary C. Detter et al Jan. 6, 1987 shows an electrical connector comprising male and female connectors which are locked together by a flexible lock arm of one connector engaging a cross piece of the other connector. When the connectors are mated, a connector position assurance and assist device is inserted axially along a tracked slot beneath the flexible lock arm to assure proper mating and prevent disengagement of the flexible latch arm from the cross piece.

U.S. Patent No. 4,708,413 issued to Diane M. Schroeder Nov. 24, 1987 shows a connector device for electric circuit comprising a pair of matable connector bodies locked together with a pump handle type of lock which is disabled by a connector position assurance device when the connector bodies are properly mated.

These prior art connectors are all characterized by a connector position assurance device which is a loose piece. This characteristic presents handling problems and requires two hands for engaging and disengaging the connector position assurance device.

SUMMARY OF THE INVENTION

The object of this invention is to provide an electrical connector comprising mating connectors which have an improved connector position assurance device for assuring that the connectors are properly mated and locked together.

A feature of the invention is that the connector position assurance device is preassembled to one of the matable electrical connectors and retained as an integral part of that electrical connector. This simplifies handling of the connector position assurance device up to the time that the connectors are mated and avoids loss of the connector position assurance device when the connectors are disconnected.

Another feature of the invention is that the connector position assurance device is slideably retained as an integral part of one of the matable electrical connectors so that the device as well as the electrical connectors can be engaged and disengaged with one hand.

Yet another feature of the invention is that the connector position assurance device is retained in an engaged position so that it prevents the primary lock from being displaced and the electrical connectors from being disconnected.

Still yet another feature of the invention is that the retention means for the connector position assurance device also positions the connector position device in a release position during connector mating.

Other objects and features of the invention will become apparent to those skilled in the art as disclosure is made in the following detailed description of a preferred embodiment of the invention which sets forth the best mode of the invention contemplated by the inventor and which is illustrated in the accompanying sheet(s) of drawing.

DETAILED DESCRIPTION OF THE PREFERRED EMBODIMENT

Figure 1:
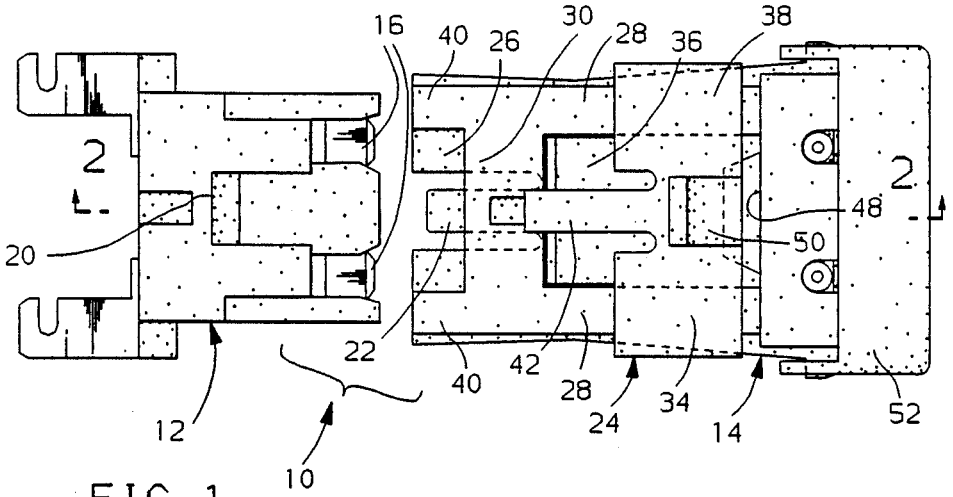
FIG. 1 is a plan view of disconnected matable electrical connectors having a connector position assurance device in accordance with this invention.
Figure 2:
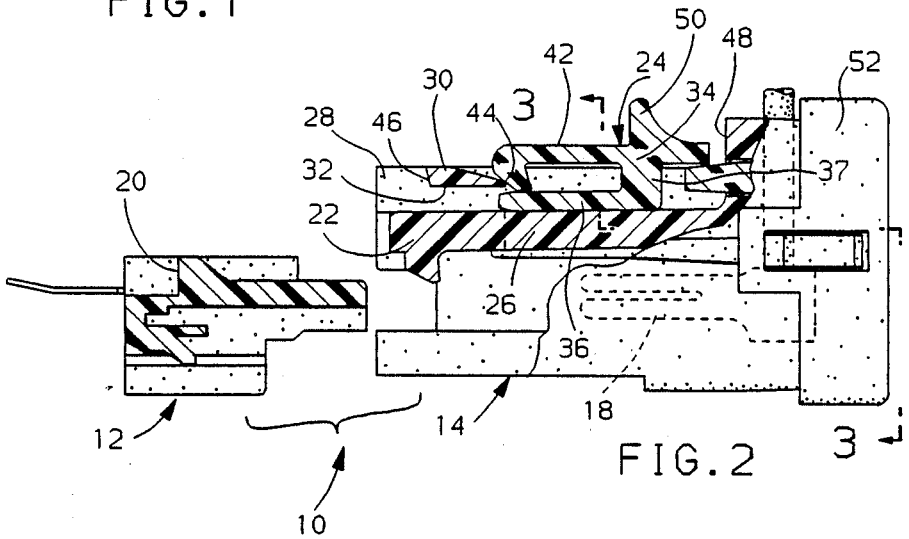
FIG. 2 is a partially sectioned elevation of the electrical connectors shown in FIG. 1.
Figure 3:
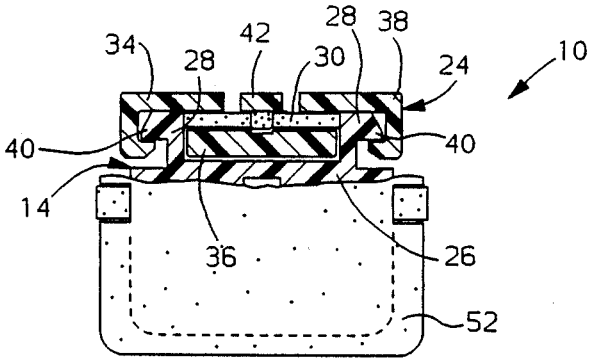
FIG. 3 is a section taken substantially along the line 3—3 of FIG. 2 looking in the direction of the arrows.

Referring now to the drawing and more particularly to FIGS. 1, 2 and 3, an electrical connector 10 comprises a plug connector body 12 and a socket connector body 14 which house electrical male terminals 16 and female terminals 18 respectively. The male terminals 16 mate with the female terminals 18 when the connector bodies 12 and 14 are mated. The plug connector body 12 has a lock shoulder 20 which is engaged by a flexible lock arm 22 of the socket connector body 14 to lock the connector bodies 20 and 22 together when the connector bodies are mated.

The electrical connector 10 further comprises a connector position assurance device or "CPA" 24 which is slideably retained on the socket connector body 14. The CPA 24 is slideably movable between a rearward release position, shown in FIGS. 1, 2, 3 and 4, where the flexible lock arm 22 is free to flex into and out of engagement with the lock shoulder 20 of the plug connector body 12 and a forward lock position, shown in FIGS. 5 and 6 where the CPA 24 prevents the flexible lock arm 22 from flexing out of engagement with the lock shoulder 20.

The socket connector body 14 has a side wall 26 which extends to a forward mating end of the socket connector body. The forward end portion of the side wall 26 is slotted to form the flexible lock arm 22 which extends forwardly in cantilever fashion from an integral attachment to the side wall 26 at the rear end of the flexible lock arm 22.

The CPA 24 is slideably retained on a pair of laterally spaced side rails 28 which are integrally attached to the side wall 26 of the socket connector body 14 on opposite sides of the flexible lock arm 22. A cross member 30 is integrally attached to the side rails 28 near the forward end of the connector body and spaced outwardly of the side wall 26 to form a gauge slot 32 which is partially defined by the flexible lock arm 22.

Figure 5:
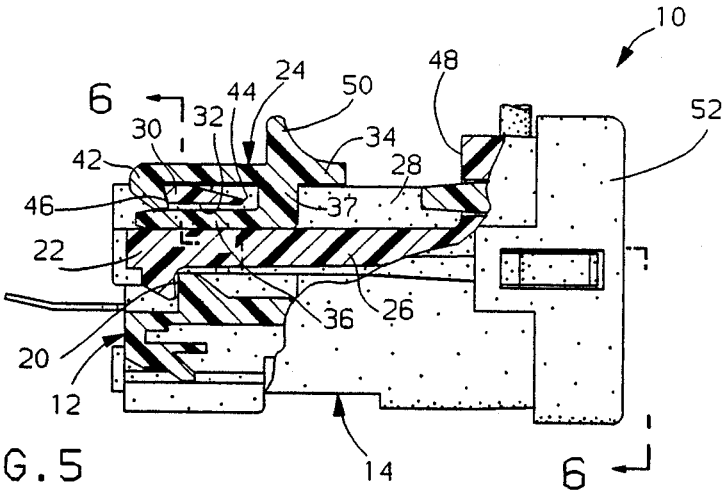
FIG. 5 is a partially sectioned elevation showing the electrical connectors fully engaged.
Figure 6:
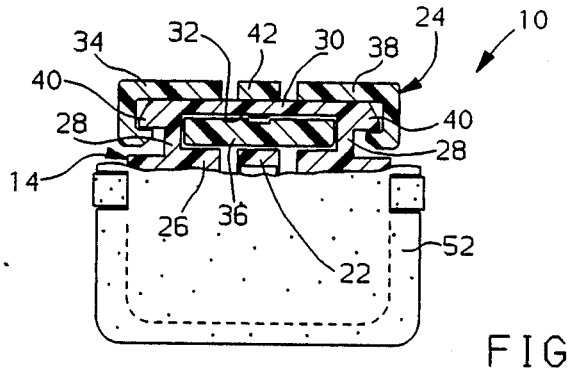
FIG. 6 is a section taken substantially along the line 6—6 of FIG. 5 looking in the direction of the arrows.

The connector position assurance device or CPA 24 comprises a clamp member 34 which is slideably disposed on the side rails 28 of the socket connector body 14 and a gauge plate 36. The gauge plate 36 is attached to the clamp member 34 by depending struts 37 at the rearward end of the gauge plate 36. The forward end of the gauge plate 36 fits into the gauge slot 32 and prevents the flexible lock arm 22 from flexing outwardly when the CPA 24 is in the forward lock position as shown in FIGS. 5 and 6.

The clamp member 34 of the CPA 24 has a C-shaped body 38 which embraces outwardly directed flanges 40 of the side rails 28 to retain the slideably mounted CPA 24 in assembly with the socket connector body 14. The C-shaped body 38 is sufficiently resilient so that the inwardly flanged ends of the C-shaped body 38 may be snapped over the outwardly directed flanges 40 of the laterally spaced side rails 28 to assemble the CPA 24 to the socket connector body 14.

Figure 4:
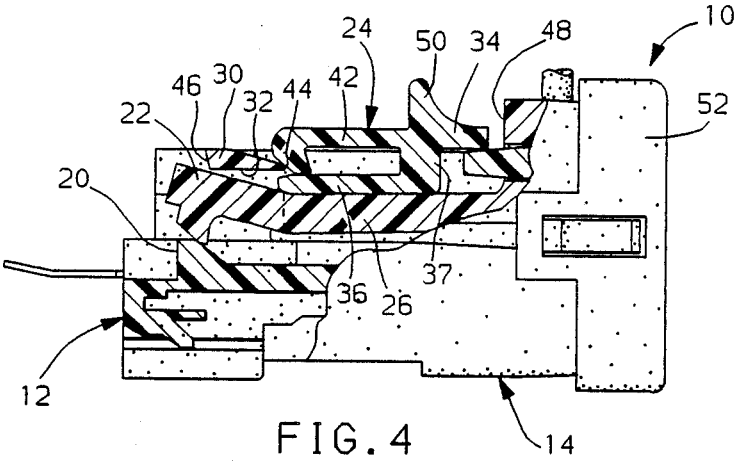
FIG. 4 is a partially sectioned elevation showing the electrical connectors partially engaged.

The clamp member 34 also has a flexible lock arm 42 which is integrally connected to and extends forwardly from the C-shaped body 38 in cantilever fashion. The free end of the flexible lock arm 42 engages a forward stop 44 at the rearward end of the cross member 30 to position the CPA 24 in a release position where the flexible lock arm 22 of the socket connector body 14 is free to flex outwardly as best shown in FIGS. 2 and 4. When the CPA 24 is moved forward to the lock position, the flexible lock arm 42 of the CPA 24 snaps over the cross member 30 and engages a lock shoulder 46 at the front of the cross member 30 to retain the CPA 24 in the lock position as best shown in FIG. 5. The forward stop 44 also limits the forward movement of the CPA 24 by engagement with the struts 37. On the other hand, the rearward movement of the CPA 24 is limited by a rearward shoulder 48 of the socket connector body 14 being engaged by the clamp member 34. The clamp member 34 also has a thumb piece 50 for sliding the CPA 24 between the forward lock and the rearward release positions. The socket connector body 14 has a cap 52 mounted on its conductor end. The cap 52 does not form any part of this invention.

The plug connector body 12 is shown aligned and ready for mating engagement with the socket connector body 14 in FIGS. 1, 2 and 3. The socket connector body 14 is readied for mating engagement by positioning the CPA 24 behind the cross member 50 where the forward stop 44 prevents the CPA 24 from sliding forward and insures that the CPA is in a release position. The socket connector body 14 is then simply grasped with the finger of one hand and pushed onto the plug connector body 12 until the connector bodies 12 and 14 are fully mated and the flexible lock arm 22 engages the lock shoulder 20 as shown in FIG. 5. During this mating engagement, the flexible lock arm 22 flexes outwardly to ride over the ramped projection of plug connector body 12 leading to lock shoulder 20 as shown in FIG. 4.

When the connector bodies 12 and 14 are fully mated and locked together by the flexible lock arm 22 engaging behind the lock shoulder 20, the CPA 24 is then simply slid forward by the thumb from the position shown in FIG. 4 to the position shown in FIGS. 5 and 6 where the gauge plate 36 is disposed in the gauge slot 32 above the flexible lock arm 22. The CPA 24 is retained in the forward lock position by the flexible lock arm 42 of the CPA 24 engaging the lock shoulder 46 of the cross member 30.

To disengage the connectors, the flexible lock arm 42 is lifted and slid back by the thumbs and the socket connector body 14 is then pulled off the plug connector body 12.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising;

a connector body which has a side wall which extends to a forward mating end of the connector body, the side wall having an integral flexible lock arm which extends forwardly in cantilever fashion for engaging a lock shoulder of a mating connector body, a cross member which is integrally attached to the side wall near the forward end of the connector body and which is spaced outwardly of the flexible lock arm, and a connector position assurance device which is slideably mounted on the connector body outwardly of the flexible lock arm, the connector position assurance device being slideably movable between a rearward release position where the flexible lock arm is free to flex outwardly toward the cross member to engage and disengage a lock shoulder of a mating connecting body and a forward lock position where the connector position assurance device is disposed between the cross member and the flexible lock arm to prevent the flexible lock arm from flexing outward toward the cross member and disengage the lock shoulder.

2. An electrical connector comprising;

a connector body which has a side wall which extends to a forward mating end of the connector body, the side wall having a flexible lock arm which extends forwardly in cantilever fashion for engaging a lock shoulder of a mating connector body, a pair of laterally spaced side rails which are integrally attached to the side wall of the connector body on opposite sides of the flexible lock arm, a cross member which is integrally attached to the side rails near the forward end of the connector body and which is spaced outwardly of the side wall of the connector body to form a gauge slot which is partially defined by the flexible lock arm, and a connector position assurance device which comprises a clamp member which is slideably disposed on the side rails of the connector body so that the connector position assurance device is slideably movable between a rearward release position where the flexible lock arm is free to flex outwardly toward the cross member to engage and disengage a lock shoulder of a mating connecting body and a forward lock position where a gauge plate which is attached to the clamp member at the rearward end of the gauge plate so that the forward end of the gauge plate fits into the gauge slot and prevents the flexible lock arm from flexing outwardly toward the cross member and disengaging the lock shoulder.

3. The electrical connector as defined in claim 2 wherein:

the laterally spaced side rails have outwardly directed flanges, and the clamp member of the connector position assurance device has a C-shaped body having inwardly directed ends which embraces the flanges to slideably retain the connector position assurance device on the connector body, the C-shaped body being sufficiently resilient so that the inwardly directed ends of the C-shaped body may be snapped over the outwardly directly flanges of the laterally spaced side rails.

4. The electrical connector as defined in claim 3 wherein:

the cross member has a lock shoulder and the clamp member has a flexible lock arm which engages the lock shoulder of the cross member to retain the connector position assurance device in the forward lock position.

5. The electrical connector as defined in claim 4 wherein:

the cross member has a forward stop which is engaged by the flexible arm of the clamp member to position the connector position assurance device in the rearward release position.

6. The electrical connector as defined in claim 5 wherein:

the clamp member has a thumb piece for sliding the connector position device between the forward lock and the rearward release positions.

* * * * *